US007357856B2

(12) United States Patent
Jacobs et al.

(10) Patent No.: US 7,357,856 B2
(45) Date of Patent: Apr. 15, 2008

(54) NITROGEN REMOVAL FROM OLEFINIC NAPHTHA FEEDSTREAMS TO IMPROVE HYDRODESULFURIZATION VERSUS OLEFIN SATURATION SELECTIVITY

(75) Inventors: Peter W. Jacobs, Baton Rouge, LA (US); Garland B. Brignac, Clinton, LA (US); Thomas R. Halbert, Baton Rouge, LA (US); Madhav Acharya, Beaumont, TX (US); Theresa A. Lelain, Bel Air, MD (US)

(73) Assignee: ExxonMobil Research and Engineering Company, Annandale, NJ (US)

( * ) Notice: Subject to any disclaimer, the term of this patent is extended or adjusted under 35 U.S.C. 154(b) by 207 days.

(21) Appl. No.: 10/937,864

(22) Filed: Sep. 9, 2004

(65) Prior Publication Data

US 2005/0098479 A1 May 12, 2005

Related U.S. Application Data

(60) Provisional application No. 60/509,089, filed on Oct. 6, 2003.

(51) Int. Cl.
*C10G 65/02* (2006.01)

(52) U.S. Cl. ..... 208/211; 208/143; 208/216 R; 208/217; 208/254 H

(58) Field of Classification Search ..... 208/143, 208/211, 216 R, 217, 254 H
See application file for complete search history.

(56) References Cited

U.S. PATENT DOCUMENTS 3,943,053 A * 3/1976 Kovach et al. ..... 208/143
4,313,821 A 2/1982 Garwood et al. ..... 208/245

(Continued)

OTHER PUBLICATIONS

Kwak, et al., "Poisoning effect of nitrogen compounds on the performance of $CoMoS/Al_2O_3$ catalyst in the hydrodesulfurization of dibenzothiophene, 4-methyldibenzothiophene, and 4,6 dimethydibenzothiophene," Applied Catalysis B, vol. 35 (2001) 59-68.

(Continued)

*Primary Examiner*—Glenn Caldarola
*Assistant Examiner*—Prem C. Singh
(74) *Attorney, Agent, or Firm*—Lawrence E. Carter

(57) ABSTRACT

A two stage process for selectively hydrodesulfurizing olefinic and sulfur and nitrogen-containing naphtha feedstreams wherein the first stage is a nitrogen removal stage to produce a naphtha feedstream having reduced levels of nitrogen compounds and a second stage wherein the naphtha feedstream having reduced levels of nitrogen compounds is hydrodesulfuried with a catalyst and under conditions selective to remove sulfur with minimum olefin saturation.

15 Claims, 2 Drawing Sheets

Effect of MEA on Selective Cat Naphtha Selectivity

U.S. PATENT DOCUMENTS

| | | | | |
|---|---|---|---|---|
| 5,298,150 | A | 3/1994 | Fletcher et al. | 208/89 |
| 5,318,690 | A | 6/1994 | Fletcher et al. | 208/89 |
| 5,320,742 | A | 6/1994 | Fletcher et al. | 208/89 |
| 5,326,462 | A | 7/1994 | Shih et al. | 208/89 |
| 5,360,532 | A | 11/1994 | Fletcher et al. | 208/89 |
| 5,500,108 | A | 3/1996 | Durand et al. | 208/89 |
| 5,510,016 | A | 4/1996 | Hilbert et al. | 208/89 |
| 5,554,274 | A | 9/1996 | Degnan et al. | 208/111 |
| 5,770,047 | A | 6/1998 | Salazar et al. | 208/254 R |
| 5,985,136 | A | 11/1999 | Brignac et al. | 208/216 R |
| 6,013,598 | A | 1/2000 | Lapinski et al. | 502/305 |
| 6,126,814 | A | 10/2000 | Lapinski et al. | 208/217 |
| 6,248,230 | B1 | 6/2001 | Min et al. | 208/213 |

OTHER PUBLICATIONS

Laredo, et al., "Inhibition effects of nitrogen compounds on the hydrodesulfurization of dibenzothiophene," Applied Catalysis A, vol. 207 (2001) 103-112.

Zuethen, et al., "Organic nitrogen compounds in gas oil blends, their hydrotreated products and the importance to hydrotreatment," Catalysis Today, vol. 65 (2001) 307-314.

Nagai, et al., "Selectivity of Molybdenum Catalyst in Hydrodesulfurization, Hydrodenitrogenation, and Hydrodeoxygenation: Effect of Additives on Dibenzothiophene Hydrodesulfurization," Journal of Catalysis, vol. 81 (1983) 440-449.

* cited by examiner

Effect of MEA on Selective Cat Naphtha Selectivity

Effect of Pyrrole Nitrogen on Selective Cat Naphtha Selectivity

NITROGEN REMOVAL FROM OLEFINIC NAPHTHA FEEDSTREAMS TO IMPROVE HYDRODESULFURIZATION VERSUS OLEFIN SATURATION SELECTIVITY

CROSS-REFERENCE TO RELATED APPLICATION

This application claims benefit of U.S. Provisional Patent Application Ser. No. 60/509,089 filed Oct. 6, 2003.

FIELD OF THE INVENTION

The instant invention relates to a process for upgrading hydrocarbon mixtures boiling within the naphtha range. More particularly, the instant invention relates to a process to produce low sulfur olefinic naphtha boiling range product streams through nitrogen removal and selective hydrotreating.

BACKGROUND OF THE INVENTION

Environmentally driven regulatory pressure concerning motor gasoline sulfur levels is expected to result in the widespread production of less than 50 wppm sulfur mogas by the year 2004. Levels below 10 wppm are being considered for later years in some regions of the world, and this will require deep desulfurization of naphthas in order to conform to emission restrictions that are becoming more stringent. The majority, i.e. 90% or more, of sulfur contaminants present in motor gasolines typically come from fluidized catalytically cracked (FCC) naphtha streams. However, FCC naphthas streams are also rich in olefins, which boost octane, a desirable quality in motor gasolines.

Thus, many processes have been developed to produce low sulfur products from olefinic naphtha boiling range streams while attempting to minimize olefin loss, such as, for example, hydrodesulfurization processes. However, these processes also typically hydrogenate feed olefins to some degree, thus reducing the octane number of the product. Therefore, processes have been developed that recover octane lost during desulfurization. Non-limiting examples of these processes can be found in U.S. Pat. Nos. 5,298,150; 5,320,742; 5,326,462; 5,318,690; 5,360,532; 5,500,108; 5,510,016; and 5,554,274, which are all incorporated herein by reference. In these processes, in order to obtain desirable hydrodesulfurization with a reduced octane loss, it is necessary to operate in two steps. The first step is a hydrodesulfurization step, and a second step recovers octane lost during hydrodesulfurization.

Processes other than those above have also been developed that seek to minimize octane lost during hydrodesulfurization. For example, selective hydrodesulfurization is used to remove organically bound sulfur while minimizing hydrogenation of olefins and octane reduction by various techniques, such as the use of selective catalysts and/or process conditions. One selective hydrodesulfurization process, referred to as SCANfining, has been developed by ExxonMobil Research & Engineering Company in which olefinic naphthas are selectively desulfurized with little loss in octane. U.S. Pat. Nos. 5,985,136; 6,013,598; and 6,126,814, all of which are incorporated by reference herein, disclose various aspects of SCANfining.

However, nitrogen-containing compounds present in refinery feedstreams are known to have a negative impact on the reaction rate of hydrodesulfurization processes. Using current industry technology nitrogen compounds are typically removed during hydroprocessing first by hydrogenation followed by hydrodenitrogenation. Thus, hydrodesulfurization processes that use catalysts having a high hydrogenation activity have been proposed to overcome the negative effects nitrogen compounds have on the hydrodesulfurization processes. However, the use of catalysts with high hydrogenation activity is typically not consistent with the need to preserve olefins during the hydrodesulfurization of olefinic naphthas.

Thus, there still exists a need in the art for an effective process to reduce the sulfur content in olefinic naphtha hydrocarbon streams, which contain nitrogen-containing compounds.

SUMMARY OF THE INVENTION

The instant invention is directed at a process for producing low sulfur olefinic naphtha boiling range product streams. The process comprises:

a) contacting an olefinic naphtha boiling range feedstream containing organically bound sulfur, nitrogen-containing compounds, and olefins with a material effective at removing at least a portion of said nitrogen-containing compounds in a first reaction stage operated under conditions effective for removing at least a portion of said nitrogen-containing compounds, thereby producing at least a first reaction zone effluent having a reduced amount of nitrogen-containing compounds; and b) contacting at least a portion of the first reaction zone effluent of step a) above with a catalyst selected from hydrodesulfurization catalysts comprising about 1 to 25 wt. % of at least one Group VI metal oxide and about 0.1 to 6 wt. % of at least one Group VIII metal oxide, a Group VIII/Group VI atomic ratio of about 0.1 to about 1.0, a median pore diameter of about 60 Å to about 200 Å, and a Group VI metal oxide surface concentration of about $0.5\times10^{-4}$ to about $3\times10^{-4}$ g of Group VI metal oxide/$m^2$ in the presence of hydrogen-containing treat gas in a second reaction stage to produce at least a desulfurized olefinic naphtha boiling range product stream wherein said second reaction stage is operated under selective hydrodesulfurizing conditions.

In a preferred embodiment of the instant invention, the Group VI metal is Mo, and the Group VIII metal is Co.

In another preferred embodiment of the present invention the hydrodesulfurization catalysts used herein also have a metals sulfide edge plane area from about 800 to 2800 μmol oxygen/g $MoO_3$ as measured by oxygen chemisorption on the catalyst in the sulfided state.

DETAILED DESCRIPTION OF THE INVENTION

Figure 1:
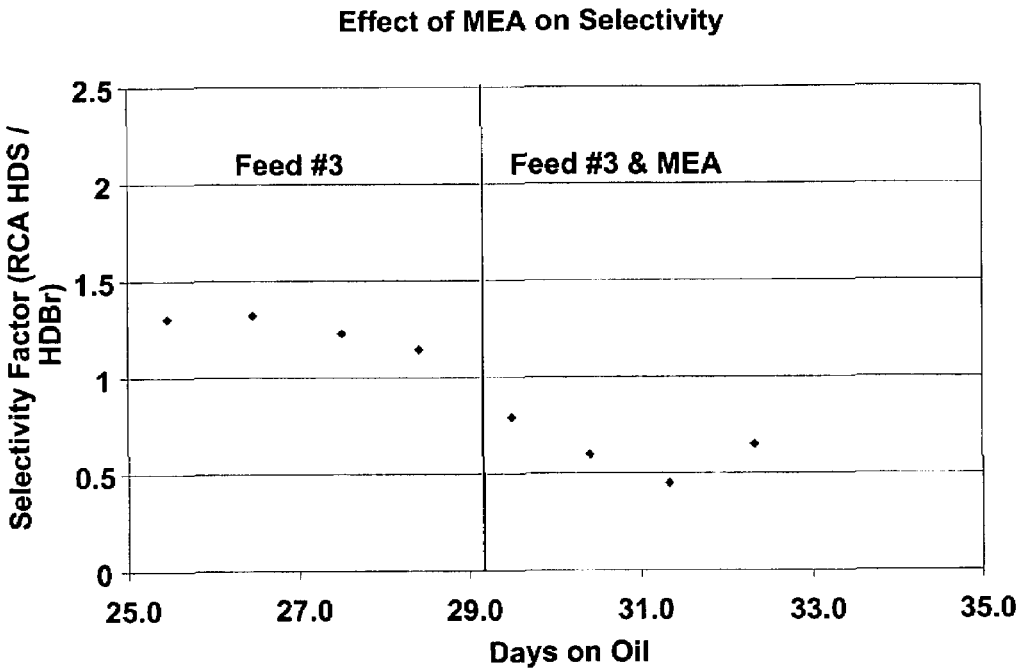
FIG. 1 demonstrates the effect of monoethanolamine on the hydrodesulfurization selectivity of an intermediate cat naphtha.

Feedstreams suitable for use in the present invention include olefinic naphtha refinery streams that typically boil in the range of about 50° (10° C.) to about 450° F. (232° C.) containing olefins as well as nitrogen and sulfur containing compounds. Thus, the term "olefinic naphtha boiling range feedstream" as used herein includes those streams having an olefin content of at least about 5 wt. %. Non-limiting examples of olefinic naphtha boiling range feedstreams that can be treated by the present invention include fluid catalytic cracking unit naphtha (FCC catalytic naphtha or cat naphtha), steam cracked naphtha, and coker naphtha. Also included are blends of olefinic naphthas with non-olefinic naphthas as long as the blend has an olefin content of at least about 5 wt. %, based on the total weight of the naphtha feedstream.

Cracked naphtha refinery streams generally contain not only paraffins, naphthenes, and aromatics, but also unsaturates, such as open-chain and cyclic olefins, dienes, and cyclic hydrocarbons with olefinic side chains. The olefinic naphtha feedstream can contain an overall olefins concentration ranging as high as about 70 wt. %, more typically as high as about 60 wt. %, and most typically from about 5 wt. % to about 40 wt. %. The olefinic naphtha feedstream can also have a diene concentration up to about 15 wt. %, but more typically less than about 5 wt. % based on the total weight of the feedstock. The sulfur content of the naphtha feedstream will generally range from about 50 wppm to about 7000 wppm, more typically from about 100 wppm to about 5000 wppm, and most typically from about 100 to about 3000 wppm. The sulfur will usually be present as organically bound sulfur. That is, as sulfur compounds such as simple aliphatic, naphthenic, and aromatic mercaptans, sulfides, di-and polysulfides and the like. Other organically bound sulfur compounds include the class of heterocyclic sulfur compounds such as thiophene, tetrahydrothiophene, benzothiophene and their higher homologs and analogs. Nitrogen can also be present in a range from about 5 wppm to about 500 wppm.

In the hydroprocessing of olefinic naphtha boiling range hydrocarbon feedstreams, it is typically highly desirable to remove sulfur-containing compounds from the olefinic naphtha boiling range feedstreams with as little olefin saturation as possible. However, during the hydrodesulfurization of olefinic naphtha boiling range feedstreams, nitrogen-containing compounds present in the feedstreams impede the catalytic reactions. It is believed that this is so because nitrogen-containing compounds, especially heterocyclic nitrogen-containing compounds, contained in these feedstreams act as competitive inhibitors on the catalytic sites of catalysts. Thus, the presence of nitrogen-containing compounds in olefinic naphtha boiling range feedstreams is known to detrimentally affect the activity of hydrodesulfurization catalysts.

The inventors hereof have discovered that in the hydrodesulfurization of olefinic naphtha boiling range feedstreams, the nitrogen-containing compounds inhibit the hydrodesulfurization reaction to a greater extent than they inhibit the hydrogenation of olefins. Thus, the inventors hereof have unexpectedly found that by reducing the nitrogen concentration of olefinic boiling range naphtha feedstreams, the hydrodesulfurization of these feedstreams becomes more selective towards hydrodesulfurization, with less octane loss during hydrodesulfurization. Therefore, the present invention seeks to reduce the detrimental effects of nitrogen-containing compounds through the use of a novel process involving contacting a olefinic naphtha boiling range feedstream containing olefins, organically-bound sulfur, and nitrogen-containing compounds in a first reaction stage containing a material effective at removing at least a portion of said nitrogen-containing compounds. The first reaction stage is operated under conditions effective for removing at least a portion of the nitrogen-containing compounds from the olefinic naphtha feedstream. At least a portion of the effluent exiting the first reaction stage is conducted to a second reaction stage containing a catalyst selected from hydrodesulfurization catalysts comprising about 1 to 25 wt. % of at least one Group VI metal oxide and about 0.1 to 6 wt. % of at least one Group VIII metal oxide, a Group VIII/Group VI atomic ratio of about 0.1 to about 1.0, a median pore diameter of about 60 Å to about 200 Å, and a Group VI metal oxide surface concentration of about $0.5\times10^{-4}$ to about $3\times10^{-4}$ g Group VI metal oxide/$m^2$. The first reaction stage effluent is contacted with the hydrodesulfurization catalyst in a second reaction stage operated under selective hydrodesulfurization conditions, and in the presence of hydrogen-containing treat gas to produce at least a desulfurized olefinic naphtha boiling range product stream.

In the first reaction stage, the above-described olefinic naphtha boiling range feedstream is contacted with a material effective at removing at least a portion of the nitrogen-containing compounds contained in the feedstream. Non-limiting examples of materials include ion exchange resins such as, for example, those of the Amberlyst group; alumina; silica, clays and other metal oxides; organic and inorganic acids, such as, for example, sulfuric acid; polar solvents such as, for example, methanol, ethylene glycol, and chemically related compounds; and any other acidic materials known to be effective at the removal of nitrogen compounds from a hydrocarbon stream. It should be noted that if sulfuric acid is selected, the sulfuric acid concentration should be selected to avoid polymerization of olefins. Preferred materials are acidic materials including ion exchange resins and alumina. More preferred is an ion exchange resin and alumina in combination.

It should be noted that spent sulfuric acid obtained from an alkylation unit could also be used to remove nitrogen contaminants. In this embodiment, the spent sulfuric acid can be diluted with water to form a sulfuric acid solution having a sulfuric acid concentration suitable for removing nitrogen contaminants. The sulfuric acid solution is typically mixed with the olefinic naphtha boiling range feedstream by the use of suitable equipment or devices such as mixing valves, mixing tanks or vessels, or through the use of a fixed bed or beds of inert materials. After the spent sulfuric acid and olefinic naphtha boiling range feedstream have been in contact under effective conditions, the two are allowed or caused to separate into a sulfuric acid solution phase and a first stage effluent phase, comprising substantially all of the olefinic naphtha boiling range feedstream. The first stage effluent is then conducted to the second reaction stage.

The first reaction stage can be comprised of one or more reactors or reaction zones each of which can comprise the same or different nitrogen removing material. In some cases, the nitrogen removing material can be present in the form of beds, with fixed beds being preferred. In this embodiment, it is preferred that at least one bed of acidic ion exchange resin and at least one bed of alumina be used in a stacked, fixed bed configuration wherein the feedstream contacts the ion exchange resin first and thence the alumina. The acidic character of the ion exchange resin combined with the polar character of alumina allow both basic and non-basic nitrogen species to be adsorbed. In this embodiment, the inventors hereof also contemplate that more than one bed of both ion exchange resin and alumina can be present such that each consecutive bed has a nitrogen removing material different from the preceding bed in relation to the flow of the olefinic naphtha boiling range feedstream. For example, if more than one bed of both acidic ion exchange resin and alumina are used, the first bed will contain ion exchange resin, the second bed alumina, the third bed ion exchange resin, the fourth bed alumina, etc. The ion exchange resin and alumina can be present in the same or different reaction vessels, however, it is preferred that they be present in the same reaction vessel. The first reaction stage can employ interstage cooling between reactors, or between beds in the same reactor if present.

The first reaction stage is operated under conditions effective for removal of at least a portion of the nitrogen-containing compounds present in the feedstream to produce a first reaction stage effluent. By at least a portion, it is meant at least about 10 wt. % of the nitrogen-containing compounds present in the feedstream. Preferably, at least about 50 wt. %, more preferably greater than 90 wt. %.

At least a portion, preferably substantially all, of the first reaction stage effluent is then conducted to a second reaction stage wherein it is contacted with a hydrodesulfurization catalyst in the presence of a hydrogen-containing treat gas under selective hydrodesulfurization conditions. There are many hydrodesulfurization catalysts in the prior art that are similar to those used in the instant invention, but none can be characterized as having all of the unique properties, and thus the level of activity for hydrodesulfurization in combination with the relatively low olefin saturation, as those used in the instant invention. For example, some conventional hydrodesulfurization catalysts typically contain Group VI oxides, for example, $MoO_3$, and Group VIII oxides, for example, CoO levels within the range of those instantly claimed. Other hydrodesulfurization catalysts have surface areas and pore diameters in the range of the instant catalysts. Only when all of the properties of the instant catalysts are present can such a high degree of hydrodesulfurization in combination with such low olefin saturation be met. The hydrodesulfurization catalysts used in the second reaction zone can be characterized by the properties: (a) a Group VI oxide, preferably $MoO_3$, concentration of about 1 to 25 wt. %, preferably about 2 to 10 wt. %, and more preferably about 3 to 6 wt. %, based on the total weight of the catalyst; (b) a Group VIII oxide, preferably CoO, concentration of about 0.1 to 6 wt. %, preferably about 0.5 to 5 wt. %, and more preferably about 1 to 3 wt. %, also based on the total weight of the catalyst; (c) a Group VIII/Group VI, preferably Co/Mo, atomic ratio of about 0.1 to about 1.0, preferably from about 0.20 to about 0.80, more preferably from about 0.25 to about 0.72; (d) a median pore diameter of about 60 Å to about 200 Å, preferably from about 75 Å to about 175 Å, and more preferably from about 80 Å to about 150 Å; (e) a Group VI oxide, preferably $MoO_3$, surface concentration of about $0.5\times10^{-4}$ to about $3\times10^{-4}$ g. Group VI metal oxide/$m^2$, preferably about $0.75\times10^{-4}$ to about $2.5\times10^{-4}$, more preferably from about $1\times10^{-4}$ to $2\times10^{-4}$; and (f) an average particle size diameter of less than 2.0 mm, preferably less than about 1.6 mm, more preferably less than about 1.4 mm, and most preferably as small as practical for a commercial hydrodesulfurization process unit.

The most preferred catalysts will also have a high degree of metal sulfide edge plane area as measured by the Oxygen Chemisorption Test described in "Structure and Properties of Molybdenum Sulfide: Correlation of $O_2$ Chemisorption with Hydrodesulfurization Activity", S. J. Tauster et al., *Journal of Catalysis,* 63, pp. 515-519 (1980), which is incorporated herein by reference. The Oxygen Chemisorption Test involves edge-plane area measurements made wherein pulses of oxygen are added to a carrier gas stream and thus rapidly traverse the catalyst bed. For example, the oxygen chemisorption will be from about 800 to 2,800, preferably from about 1,000 to 2,200, and more preferably from about 1,200 to 2,000 μmol oxygen/gram $MoO_3$.

The hydrodesulfurization catalysts used in the present invention are supported catalysts. Any suitable inorganic oxide support material may be used for the catalyst of the present invention. Non-limiting examples of suitable support materials include: alumina, silica, titania, calcium oxide, strontium oxide, barium oxide, carbons, zirconia, diatomaceous earth, lanthanide oxides including cerium oxide, lanthanum oxide, neodynium oxide, yttrium oxide, and praesodynium oxide; chromia, thorium oxide, urania, niobia, tantala, tin oxide, zinc oxide, and aluminum phosphate. Preferred are alumina, silica, and silica-alumina. More preferred is alumina. For the catalysts with a high degree of metal sulfide edge plane area of the present invention, magnesia can also be used. It is to be understood that the support material can contain small amount of contaminants, such as Fe, sulfates, silica, and various metal oxides, which can be present during the preparation of the support material. These contaminants are present in the raw materials used to prepare the support and will preferably be present in amounts less than about 1 wt. %, based on the total weight of the support. It is more preferred that the support material be substantially free of such contaminants. It is an embodiment of the present invention that about 0 to 5 wt. %, preferably from about 0.5 to 4 wt. %, and more preferably from about 1 to 3 wt. %, of an additive be present in the support, which additive is selected from the group consisting of phosphorus, potassium, and metals or metal oxides from Group IA (alkali metals) of the Periodic Table of the Elements. The hydrodesulfurization of the first stage effluent typically begins by preheating an olefinic naphtha boiling range feedstream. The olefinic naphtha boiling range feedstream can be reacted with the hydrogen-containing treat gas stream prior to, during, and/or after preheating. At least a portion of the hydrogen-containing treat gas can also be added at an intermediate location in the hydrodesulfurization, or second, reaction stage. Hydrogen-containing treat gasses suitable for use in the presently disclosed process can be comprised of substantially pure hydrogen or can be mixtures of other components typically found in refinery hydrogen streams. It is preferred that the hydrogen-containing treat gas stream contains little, more preferably no, hydrogen sulfide. The hydrogen-containing treat gas purity should be at least about 50% by volume hydrogen, preferably at least about 75% by volume hydrogen, and more preferably at least about 90% by volume hydrogen for best results. It is most preferred that the hydrogen-containing stream be substantially pure hydrogen.

The second reaction stage can consist of one or more fixed bed reactors each of which can comprise a plurality of catalyst beds. Since some olefin saturation will take place and olefin saturation and the desulfurization reaction are generally exothermic, consequently interstage cooling between fixed bed reactors, or between catalyst beds in the same reactor shell, can be employed. A portion of the heat generated from the hydrodesulfurization process can be recovered and where this heat recovery option is not available, cooling may be performed through cooling utilities such as cooling water or air, or through use of a hydrogen quench stream. In this manner, optimum reaction temperatures can be more easily maintained.

As previously stated, the first reaction stage effluent is contacted with the above-defined hydrodesulfurization catalyst in a second reaction stage under selective hydrotreating conditions to produce at least a desulfurized olefinic naphtha boiling range product stream. Selective hydrotreating conditions are generally considered those conditions that are designed to maximize the amount of sulfur removed from the olefinic naphtha boiling range feedstream while at the same time minimizing olefin saturation. The preferred selective hydrodesulfurization conditions are those described in U.S. Pat. Nos. 5,985,136; 6,013,598; and 6,126,814, all of which have already been incorporated by reference herein, which disclose various aspects of SCANfining, a process developed by the ExxonMobil Research & Engineering Company in which olefinic naphthas are selectively desulfurized with little loss in octane. These conditions generally include liquid hourly space velocities (LHSV) of from about 0.5 $hr^{-1}$ to about 15 $hr^{-1}$, preferably from about 0.5 $hr^{-1}$ to about 10 $hr^{-1}$, and most preferably from about 1 $hr^{-1}$ to about 5 $hr^{-1}$. Selective hydrodesulfurization conditions also include temperatures that generally range from about 450 to about 700° F., preferably from about 500 to about 670° F.; total pressures generally ranging from about 200 to about 800 psig, preferably 200 to about 500 psig, and hydrogen treat gas rates range from about 200 to about 5000 Standard Cubic Feed per Barrel (SCF/bbl), preferably about 2000 to about 5000 SCF/bbl. Reaction pressures and hydrogen circulation rates below these ranges can result in higher catalyst deactivation rates resulting in less effective selective hydrodesulfurization. Excessively high reaction pressures increase energy and equipment costs and provide diminishing marginal benefits. However, it should be noted that the selective hydrodesulfurization conditions described above are generally operated in an all vapor-phase mode. By all vapor phase mode, it is meant that the olefinic naphtha boiling range feedstream is a vapor when it is contacted with the hydrodesulfurization catalyst, i.e. the olefinic naphtha boiling range feedstream is completely vaporized at the reactor inlet temperature.

The above description is directed to several embodiments of the present invention. Those skilled in the art will recognize that other embodiments that are equally effective could be devised for carrying out the spirit of this invention.

The following examples will illustrate the improved effectiveness of the present invention, but is not meant to limit the present invention in any fashion.

EXAMPLES

Example 1

3 gallons of full-range cat naphtha having a nitrogen level of 256 wppm, as measured by ASTM 4629, a bromine number of 77, as measured by ASTM 1159, and a sulfur level of 1264 wppm, as measured by x-ray fluorescence, was treated to remove nitrogen by passing the full-range cat naphtha through a 4" diameter glass column charged with a bed of 600 g of Amberlyst 15 cation exchange resin and a second bed of 300 g activated alumina. The oil was passed through the combined bed of resin and alumina at room temperature and at a liquid hourly space velocity of 0.5 $hr^{-1}$.

After the full-range cat naphtha has been treated with the Amberlyst 15 and alumina, the nitrogen content, bromine number, and sulfur content was again measured. The treated full-range cat naphtha had a nitrogen level of 20 wppm, a bromine number of 75.8, and a sulfur level of 1190 wppm.

Example 2

A full range naphtha, referred to herein as Feed #1, having a nitrogen level of 1264 wppm, as measured by ASTM 4629, a bromine number of 77, as measured by ASTM 1159, and a sulfur level of 1264 wppm, as measured by x-ray fluorescence, was hydrodesulfurized in a 100 cc schedule 80, ½" diameter, 26" long pipe reactor charged with a 50 cc bed of commercial hydrodesulfurization catalyst comprising 4.3 wt. % $MoO_3$, 1.2 wt. % CoO, on alumina with a median pore diameter of 95 Å The full range naphtha was hydrodesulfurized under conditions including temperatures of 525° F., hydrogen treat gas rates of 2000 scf/bbl substantially pure hydrogen, pressures of 235 psig, and liquid hourly space velocities ("LHSV") of 3.9 $hr^{-1}$. After lining out the catalyst, the sulfur and bromine number of the desulfurized full range naphtha were measured to be 580 wppm and 70, respectively.

The objective was to determine the effect of nitrogen on octane loss at a given level of desulfurization. Thus, the relative catalyst activity ("RCA") was calculated for hydrodesulfurization ("HDS") and bromine number reduction ("HDBr"). RCA is a measure of the reaction rate for HDS and HDBr calculated using a model that assumes that the rate of HDS and HDBr are first order in sulfur and olefin saturation, respectively, and the model also takes into account the potential for the reaction of $H_2S$ with olefins to form mercaptans. After calculating the RCA for HDS and HDBr, the selectivity factor of the catalyst towards HDS rather than olefin hydrogenation was calculated by dividing the RCA for HDS by the RCA for HDBr. The greater the selectivity factor, the greater the preference for sulfur removal over olefin hydrogenation. The results are contained in Table 1 below.

The objective of this example was to determine the effect of nitrogen on octane loss and HDBr, at a given level of desulfurization. It should be noted that olefin saturation is expressed as a reduction of bromine number (HDBr), which is directly related to the olefin content.

Example 3

The same full range naphtha feed of Example 2 was treated with the Amberlyst 15 resin and alumina as outlined in Example 1 to reduce the nitrogen level to 20 ppm, with the other feed properties remaining substantially constant. The treated feed was then subjected to hydrodesulfurization with the same catalyst, reactor, catalyst loading, and conditions outlined in Example 2. When this treated feed, referred to herein as Feed #2 was subjected to hydrodesulfurization, the sulfur level was reduced to 400 wppm while the Bromine number only marginally decreased to 68. The RCA for HDS and HDBr and selectivity were again calculated according to the methods outlined in Example 2. The results are contained in Table 1 below.

TABLE 1

RELATIVE CATALYST ACTIVITY FOR HDS AND HDBr

| Feed No. | RCA for HDS | RCA for HDBr | Selectivity Factor ($RCA_{HDS}/RCA_{HDBr}$) |
|---|---|---|---|
| 1 | 33.4 | 47.3 | 0.706 |
| 2 | 48.6 | 46.6 | 1.043 |

Example 4

An intermediate cat naphtha, referred to herein as Feed #3, having a nitrogen level of 31 wppm, as measured by ASTM 4629, a bromine number of 59.2, as measured by ASTM 1159, and a sulfur level of 1324 wppm, as measured by x-ray fluorescence, was hydrodesulfurized in a fixed bed reactor of the same type used in example #2 charged with a 40 cc bed of commercial hydrodesulfurization catalyst comprising 4.3 wt. % $MoO_3$, 1.2 wt. % CoO, on alumina with a median pore diameter of 95 Å The full range naphtha was hydrodesulfurized under conditions including temperatures of 525° F., hydrogen treat gas rates of 2000 scf/bbl substantially pure hydrogen, pressures of 240 psig, and liquid hourly space velocities ("LHSV") of 4.8 $hr^{-1}$. After lining out the catalyst, the sulfur and bromine number of the desulfurized full range naphtha were measured to be 580 wppm and 70, respectively.

The catalyst was lined out on the feed and the selectivity for the catalyst and the feed determined. After line out, a 3.6 M aqueous solution monoethanolamine (MEA), a nitrogen containing compound, was injected into the reactor at a rate of 1 cc/hr to determine the effects of nitrogen on desulfurization of the intermediate cat naphtha. The resulting effect of the MEA was a decrease in the selectivity of the catalyst. Again, the selectivity factor is defined as the ratio of the RCA for HDS to the RCA for HDBr. The results of this experiment are contained in FIG. 1.

As can be seen in FIG. 1, the average selectivity of the commercial hydrodesulfurization catalyst on Feed #3 is 1.25. The average selectivity when MEA is present is 0.62. Thus, FIG. 1 illustrates that the presence of nitrogen-containing compounds decreases the selectivity of the hydrodesulfurization process.

Example 5

Example 5 illustrates the effects of "spiking" pyrrole, a 5 member-ring with a nitrogen-compound in one position, into the naphtha feed during a pilot unit hydrodesulfurization process. A 25 cc charge of commercial hydrodesulfurization catalyst comprising 4.3 wt. % $MoO_3$, 1.2 wt. % CoO, on alumina with a median pore diameter of 95 Å and 75 cc of inert particles was loaded into a of a fixed bed reactor of the same type used in the previous examples. A heavy cat naphtha, referred to herein as Feed #4, containing 978 wppm total sulfur, 49.8 bromine number and 29 wppm nitrogen was used as the feedstock to the pilot unit. The pyrrole "spiking", also referred to herein as "nitrogen spiking", was performed by injecting 130 wppm pyrrole into the feed to increase the total nitrogen content of Feed #4 to 159 wppm.

Feed #4 was hydrodesulfurized under conditions including temperatures of 525° F., hydrogen treat gas rates of 1000 scf/bbl substantially pure hydrogen, pressures of 200 psig, and liquid hourly space velocities ("LHSV") of 1 $hr^{-1}$, which allowed for all vapor-phase hydrodesulfurization. The RCA for HDS and HDBr was measured to be 43 and 45, respectively under these operating conditions.

The feed was then spiked with pyrrole, and the RCA for HDS and HDBr were again measured and found to be 29 and 41, respectively. The results of this experiment are shown in FIG. 2.

Figure 2:
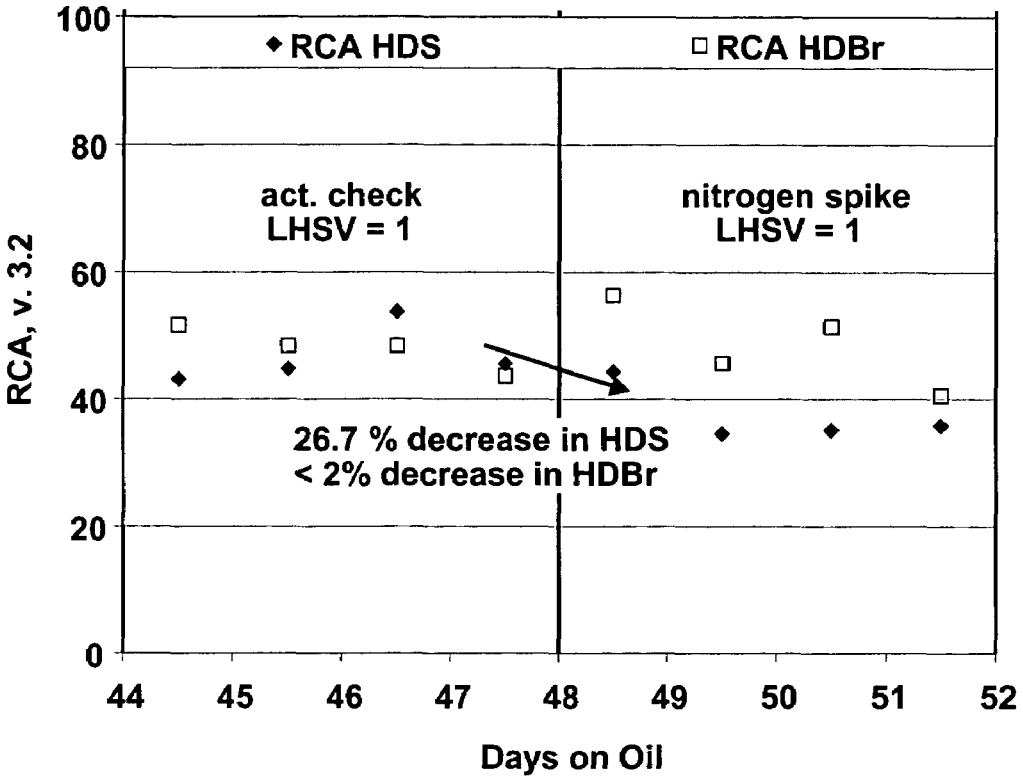
FIG. 2 demonstrates the effect of pyyrole on the hydrodesulfurization selectivity of a heavy cat naphtha.

FIG. 2 demonstrates that the presence of 130 wppm of pyrrole resulted in a 26.7% decrease in HDS activity while the HDBr activity remained fairly constant.

The invention claimed is:

1. A process for producing low sulfur naphtha product streams comprising:

a) contacting an olefinic naphtha boiling range feedstream containing organically bound sulfur, nitrogen-containing compounds, and olefins with (i) at least one acidic material effective at removing at least a portion of said nitrogen-containing compounds, and (ii) at least one polar material effective at removing at least a portion of said nitrogen-containing compounds, the polar material being different than the acidic material, in a first reaction stage operated under conditions effective at removing at least a portion of said nitrogen-containing compounds thereby producing at least a first reaction stage effluent having a reduced amount of nitrogen-containing compounds; and b) contacting at least a portion of the first reaction stage effluent of step a) above with a catalyst selected from hydrodesulfurization catalysts comprising about 1 to 25 wt. % of at least one Group VI metal oxide and about 0.1 to 6 wt. % of at least one Group VIII metal oxide, a Group VIII to Group VI atomic ratio of about 0.1 to about 1.0, a median pore diameter of about 60 Å to about 200 Å, and a Group VI metal oxide surface concentration of about $0.5\times10^{-4}$ to about $3\times10^{-4}$ g Group VI metal oxide/$m^2$ in the presence of hydrogen-containing treat gas in a second reaction stage to produce at least a desulfurized olefinic naphtha boiling range product stream wherein said second reaction stage is operated under selective hydrodesulfurizing conditions.

2. The method of claim 1, wherein the acidic material and the polar material are contained in stacked beds, the beds arranged such that an olefinic naphtha boiling range feedstream passing through the beds alternates between contact with an acidic material bed and a polar material bed.

3. The method of claim 1, wherein the acidic material comprises an ion exchange resin and the polar material comprises alumina.

4. The process of claim 1 wherein said first reaction stage and said second reaction stage comprise one or more reactors or reaction zones.

5. The process according to claim 1 wherein said first reaction stage and said second reaction stage comprises one or more catalyst beds selected from the group consisting of fluidized beds, ebullating beds, slurry beds, fixed beds, and moving beds.

6. The process according to claim 1 wherein said desulfurized product stream contains less than 100 wppm sulfur.

7. The process according to claim 1 wherein said first reaction stage and said second reaction stage comprise one or more fixed catalyst beds.

8. The process according to claim 1 wherein said process further comprises interstage cooling between said first and second reaction stage, or between catalyst beds or reaction zones in said first and second reaction stages.

9. The process according to claim 1 wherein said inorganic oxide support of said hydrodesulfurization catalyst also contains about 0 to 5 wt. % of an additive selected from the group consisting of phosphorus, potassium, and metals or metal oxides from Group IA (alkali metals) of the Periodic Table of the Elements.

10. The process according to claim 1 wherein said inorganic oxide support is alumina.

11. The process according to claim 1 wherein said selective hydrodesulfurization conditions are selected in such a manner that said desulfurized product stream has a sulfur level less than 50 wppm sulfur.

12. The process according to claim 1 wherein said selective hydrodesulfurization conditions include liquid hourly space velocities (LHSV) of from about 0.5 $hr^{-1}$ to about 15 $hr^{-1}$, temperatures from about 450 to about 700° F.; total pressures from about 200 to about 800 psig, and hydrogen treat gas rates range from about 200 to about 5000 Standard Cubic Feed per Barrel (SCF/bbl), preferably about 2000 to about 5000 SCF/bbl.

13. The process according to claim 1 wherein said selective hydrodesulfurization conditions are selected such that the hydrodesulfurization reaction is carried out in an all vapor phase mode.

14. The process according to claim 1 wherein said second catalyst is a hydrodesulfurization catalyst selected from hydrodesulfurization catalysts comprising about 2 to 10 wt. % $MoO_3$, based on the total weight of the catalyst; about 0.5 to 5 wt. % CoO, based on the total weight of the catalyst; a Co/Mo atomic ratio of about 0.20 to about 0.80; a median pore diameter of about 75 Å to about 175 Å; and a $MoO_3$ surface concentration of about $0.75\times10^{-4}$ to about $2.5\times10^{-4}$ g. $MoO_3/m^2$; and an average particle size diameter of less than 2.0 mm.

15. The process according to claim 1 wherein the hydrodesulfurization catalysts have a metals sulfide edge plane area from about 800 to 2800 μmol oxygen/g $MoO_3$ as measured by oxygen chemisorption.

* * * * *